US008626021B2

(12) United States Patent
Taguchi

(10) Patent No.: US 8,626,021 B2
(45) Date of Patent: Jan. 7, 2014

(54) DEVELOPER SUPPLY DEVICE HAVING SIDE SEAL MEMBERS TO PREVENT TONER LEAKAGE, AND IMAGE FORMING APPARATUS HAVING THE SAME

(75) Inventor: Kazuna Taguchi, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 308 days.

(21) Appl. No.: 13/073,732

(22) Filed: Mar. 28, 2011

(65) Prior Publication Data

US 2011/0311266 A1 Dec. 22, 2011

(30) Foreign Application Priority Data

Jun. 18, 2010 (JP) ..... 2010-138835

(51) Int. Cl.
*G03G 15/08* (2006.01)

(52) U.S. Cl.
USPC ..... 399/103

(58) Field of Classification Search
USPC ..... 399/103, 281
See application file for complete search history.

(56) References Cited

U.S. PATENT DOCUMENTS

| | | | | |
|---|---|---|---|---|
| 5,027,157 | A * | 6/1991 | Hotomi et al. | 399/253 |
| 2004/0037593 | A1 * | 2/2004 | Sakuma et al. | 399/265 |
| 2006/0140674 | A1 * | 6/2006 | Sato | 399/119 |
| 2009/0175662 | A1 | 7/2009 | Nishiwaki | |

FOREIGN PATENT DOCUMENTS

| | | | |
|---|---|---|---|
| JP | 2003122115 | A * | 4/2003 |
| JP | 2006047654 | A * | 2/2006 |
| JP | 2008-070803 | A | 3/2008 |
| JP | 2009080299 | A * | 4/2009 |
| JP | 2010-145910 | A | 7/2010 |

* cited by examiner

*Primary Examiner* — Quana M Grainger
(74) *Attorney, Agent, or Firm* — Scully, Scott, Murphy & Presser, PC

(57) ABSTRACT

A developer supply device is provided, which includes side seal members each of which is disposed to extend across a casing-side facing portion of a casing and a supporting-member-side facing portion of a board supporting member, the casing-side facing portion and the supporting-member-side facing portion facing one of both ends of a developer carrying surface in a first direction, the developer carrying surface being a cylindrical circumferential surface of a roller main body which surface is formed parallel to the first direction to carry development agent thereon. Each of the side seal member is configured to slide in contact with one of both ends of the developer carrying surface in the first direction while filling in a gap between the casing and one of both ends of the roller main body in the first direction.

16 Claims, 9 Drawing Sheets

DEVELOPER SUPPLY DEVICE HAVING SIDE SEAL MEMBERS TO PREVENT TONER LEAKAGE, AND IMAGE FORMING APPARATUS HAVING THE SAME

CROSS-REFERENCE TO RELATED APPLICATION

This application claims priority under 35 U.S.C. §119 from Japanese Patent Application No. 2010-138835 filed on Jun. 18, 2010. The entire subject matter of the application is incorporated herein by reference.

BACKGROUND

1. Technical Field

The following description relates to one or more developer supply devices configured to supply charged powdered development agent to an intended device.

2. Related Art

A developer supply device has been known that includes a photoconductive drum, a development roller, and a developer electric-field transfer unit.

The development roller is disposed to face the photoconductive drum in a predetermined area. The development roller has a developer holding surface configured to hold and carry charged development agent thereon.

The developer electric-field transfer unit is disposed to face the developer holding surface across a predetermined distance at an upstream side relative to the development area in a moving direction of the developer holding surface (i.e., a moving direction of a circumferential surface of the development roller which surface moves in response to rotation of the development roller). The developer electric-field transfer unit includes a plurality of transfer electrodes. The developer electric-field transfer unit is configured to transfer the development agent by the action of a traveling-wave electric field generated when a transfer bias containing a multi-phase alternating-current (AC) voltage component is applied to the transfer electrodes.

In such a configuration, the development agent, transferred under the traveling-wave electric-field generated by the developer electric-field transfer unit, adheres onto the developer holding surface in a position where the developer electric-field transfer unit faces the development holding surface. Namely, in the position, the development agent is held and carried on the developer holding surface.

The development agent held on the developer holding surface is conveyed up to the development area with the developer holding surface moving in response to rotation of the development roller, and supplied for development of an electrostatic latent image. Thereby, the development agent adheres, in a shape of an image corresponding to the electrostatic latent image, onto an electrostatic latent image holding surface as a circumferential surface of the photoconductive drum. In other words, the electrostatic latent image on the electrostatic latent image holding surface is developed with the development agent. Thereby, an image of development agent (a developer image) is formed on the electrostatic latent image holding surface.

SUMMARY

In a developer supply device of this kind, it is required to prevent as effectively as practicable the development agent from leaking to the outside of the device.

Aspects of the present invention are advantageous to provide one or more improved techniques for a developer supply device, which techniques make it possible to prevent as effectively as practicable the development agent from leaking to the outside of the device.

According to aspects of the present invention, a developer supply device is provided, which is configured to supply charged development agent to an intended device. The developer supply device includes a roller-shaped developer carrying member including a cylindrical roller main body having a developer carrying surface that is formed as a cylindrical circumferential surface parallel to a first direction and configured to carry the development agent, and a shaft that protrudes outward from both ends of the roller main body in the first direction, the developer carrying member being configured to rotate around the shaft such that the developer carrying surface moves in a second direction perpendicular to the first direction to transfer the development agent carried thereon to a first position where the developer carrying surface faces the intended device, a casing including a casing main body formed as a U-shaped plate member having a substantially U-shaped cross-section along a plane perpendicular to the first direction, and side frames that are formed as flat plate members and disposed on both sides of the casing main body in the first direction, respectively, the casing main body and the side frames forming, inside a space surrounded thereby, a developer storage section configured to accommodate the development agent, the casing being configured to rotatably support the developer carrying member by the side frames at an opening of the U-shaped casing main body, a transfer board including a plurality of transfer electrodes that have a longitudinal direction parallel to the first direction and are arranged along a direction perpendicular to the first direction, the transfer board being disposed inside the casing so as to face the developer carrying surface in a second position upstream relative to the first position in the second direction, the transfer board being configured to transfer the development agent to the second position under a traveling-wave electric field generated when a multi-phase alternating-current voltage is applied to the transfer electrodes, such that the developer carrying member receives and carries the development agent on the developer carrying surface in the vicinity of the second position, a board supporting member disposed inside the space surrounded by the casing main body and the side frames, the board supporting member being configured to support the transfer board on an outer surface thereof and extend from the developer storage section to the second position, and side seal members each of which is disposed to extend across a casing-side facing portion that is a portion of the casing and a supporting-member-side facing portion that is a portion of the board supporting member, the casing-side facing portion and the supporting-member-side facing portion facing one of both ends of the developer carrying surface in the first direction, each of the side seal member filling in a gap between the casing and one of both ends of the roller main body in the first direction so as to prevent the development agent from leaking to an outside of the casing via the gap, the side seal members being configured to slide in contact with the both ends of the developer carrying surface in the first direction, respectively.

According to aspects of the present invention, an image forming apparatus is provided, which includes a photoconductive body configured such that a development agent image is formed thereon, and a developer supply device configured to supply charged development agent to the photoconductive body. The developer supply device includes a roller-shaped developer carrying member including a cylindrical roller main body having a developer carrying surface that is formed as a cylindrical circumferential surface parallel to a first direction and configured to carry the development agent, and a shaft that protrudes outward from both ends of the roller main body in the first direction, the developer carrying member being configured to rotate around the shaft such that the developer carrying surface moves in a second direction perpendicular to the first direction to transfer the development agent carried thereon to a first position where the developer carrying surface faces the photoconductive body, a casing including a casing main body formed as a U-shaped plate member having a substantially U-shaped cross-section along a plane perpendicular to the first direction, and side frames that are formed as flat plate members and disposed on both sides of the casing main body in the first direction, respectively, the casing main body and the side frames forming, inside a space surrounded thereby, a developer storage section configured to accommodate the development agent, the casing being configured to rotatably support the developer carrying member by the side frames at an opening of the U-shaped casing main body, a transfer board including a plurality of transfer electrodes that have a longitudinal direction parallel to the first direction and are arranged along a direction perpendicular to the first direction, the transfer board being disposed inside the casing so as to face the developer carrying surface in a second position upstream relative to the first position in the second direction, the transfer board being configured to transfer the development agent to the second position under a traveling-wave electric field generated when a multi-phase alternating-current voltage is applied to the transfer electrodes, such that the developer carrying member receives and carries the development agent on the developer carrying surface in the vicinity of the second position, a board supporting member disposed inside the space surrounded by the casing main body and the side frames, the board supporting member being configured to support the transfer board on an outer surface thereof and extend from the developer storage section to the second position, and side seal members each of which is disposed to extend across a casing-side facing portion that is a portion of the casing and a supporting-member-side facing portion that is a portion of the board supporting member, the casing-side facing portion and the supporting-member-side facing portion facing one of both ends of the developer carrying surface in the first direction, each of the side seal member filling in a gap between the casing and one of both ends of the roller main body in the first direction so as to prevent the development agent from leaking to an outside of the casing via the gap, the side seal members being configured to slide in contact with the both ends of the developer carrying surface in the first direction, respectively.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct or indirect and that this specification is not intended to be limiting in this respect.

Hereinafter, an embodiment according to aspects of the present invention will be described with reference to the accompany drawings.

<Configuration of Laser Printer>

Figure 1:
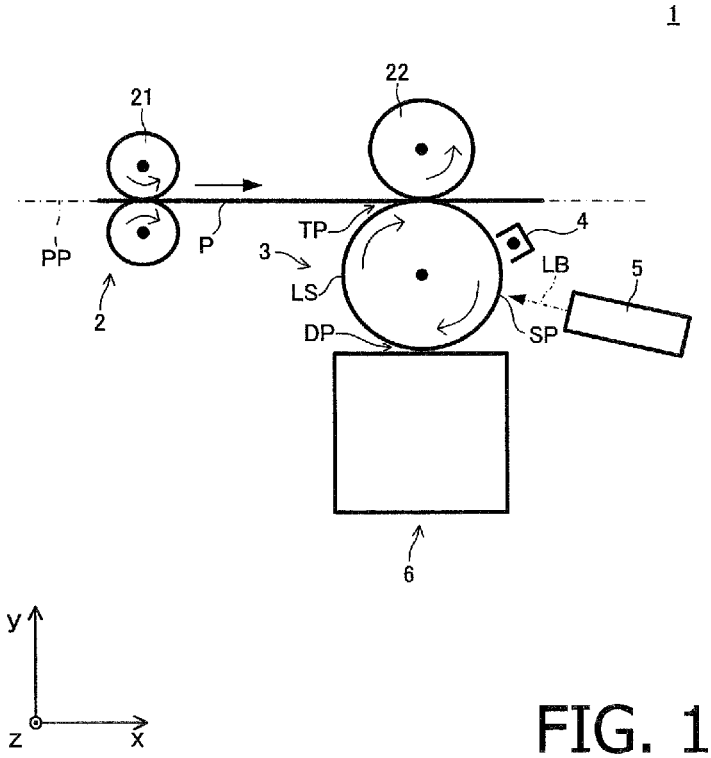
FIG. 1 is a side view schematically showing a configuration of a laser printer in an embodiment according to one or more aspects of the present invention.

As illustrated in FIG. 1, a laser printer 1 includes a sheet feeding mechanism 2, a photoconductive drum 3, an electrification device 4, a scanning unit 5, and a toner supply device 6. A feed tray (not shown), provided in the laser printer 1, is configured such that a stack of sheets P is placed thereon. The sheet feeding mechanism 2 is configured to feed a sheet P along a predetermined sheet feeding path PP.

On a circumferential surface of the photoconductive drum 3, an electrostatic latent image carrying surface LS is formed as a cylindrical surface parallel to a main scanning direction (i.e., the z-axis direction in FIG. 1). The electrostatic latent image carrying surface LS is configured such that an electrostatic latent image is formed thereon in accordance with an electric potential distribution. Further, the electrostatic latent image carrying surface LS is configured to hold toner in positions corresponding to the electrostatic latent image. It is noted that in the embodiment, the toner is positively-chargeable nonmagnetic-one-component dry-type black toner. The photoconductive drum 3 is driven to rotate in a direction (clockwise in FIG. 1) as indicated by arrows in FIG. 1 around an axis parallel to the main scanning direction. Thus, the photoconductive drum 3 is configured to move the electrostatic latent image carrying surface LS along an auxiliary scanning direction perpendicular to the main scanning direction.

The electrification device 4 is disposed to face the electrostatic latent image carrying surface LS. The electrification device 4, which is of a corotron type or a scorotron type, is configured to positively and evenly charge the electrostatic latent image carrying surface LS.

The scanning unit 5 is configured to generate a laser beam LB modulated based on image data. Specifically, the scanning unit 5 generates the laser beam LB within a predetermined wavelength range, which laser beam LB is emitted under ON/OFF control depending on whether there is a pixel in a target location on the image data. In addition, the scanning unit 5 is configured to converge the laser beam LB in a scanned position SP on the electrostatic latent image carrying surface LS, and to move (scan) the position where the laser beam LB is converged on the electrostatic latent image carrying surface LS, along the main scanning direction at a constant speed. Here, the scanned position SP is set in a downstream position relative to the electrification device 4 in the rotational direction of the photoconductive drum 3 (i.e., the clockwise direction indicated by the arrows in FIG. 1).

The toner supply device 6 is disposed under the photoconductive body 3 so as to face the photoconductive body 3. The toner supply device 6 is configured to supply the charged toner, in a development position DP, onto the photoconductive drum 3 (the electrostatic latent image carrying surface LS). It is noted that the development position DP denotes a position where the toner supply device 6 faces the electrostatic latent image carrying surface LS in closest proximity thereto. A detailed explanation will be provided later about the configuration of the toner supply device 6.

Subsequently, a detailed explanation will be provided about a specific configuration of each element included in the laser printer 1.

The sheet feeding mechanism 2 includes a pair of registration rollers 21, and a transfer roller 22. The registration rollers 21 are configured to feed a sheet P toward between the photoconductive drum 3 and the transfer roller 22 at a predetermined moment. The transfer roller 22 is disposed to face the electrostatic latent image carrying surface LS across the sheet feeding path PP in a transfer position TP. Additionally, the transfer roller 22 is driven to rotate in a direction (counterclockwise in FIG. 1) as indicated by an arrow in FIG. 1. The transfer roller 22 is configured such that a predetermined transfer bias is applied thereto for transferring, onto the sheet P, the toner adhering onto the electrostatic latent image carrying surface LS.

<<Toner Supply Device>>

Figure 2:
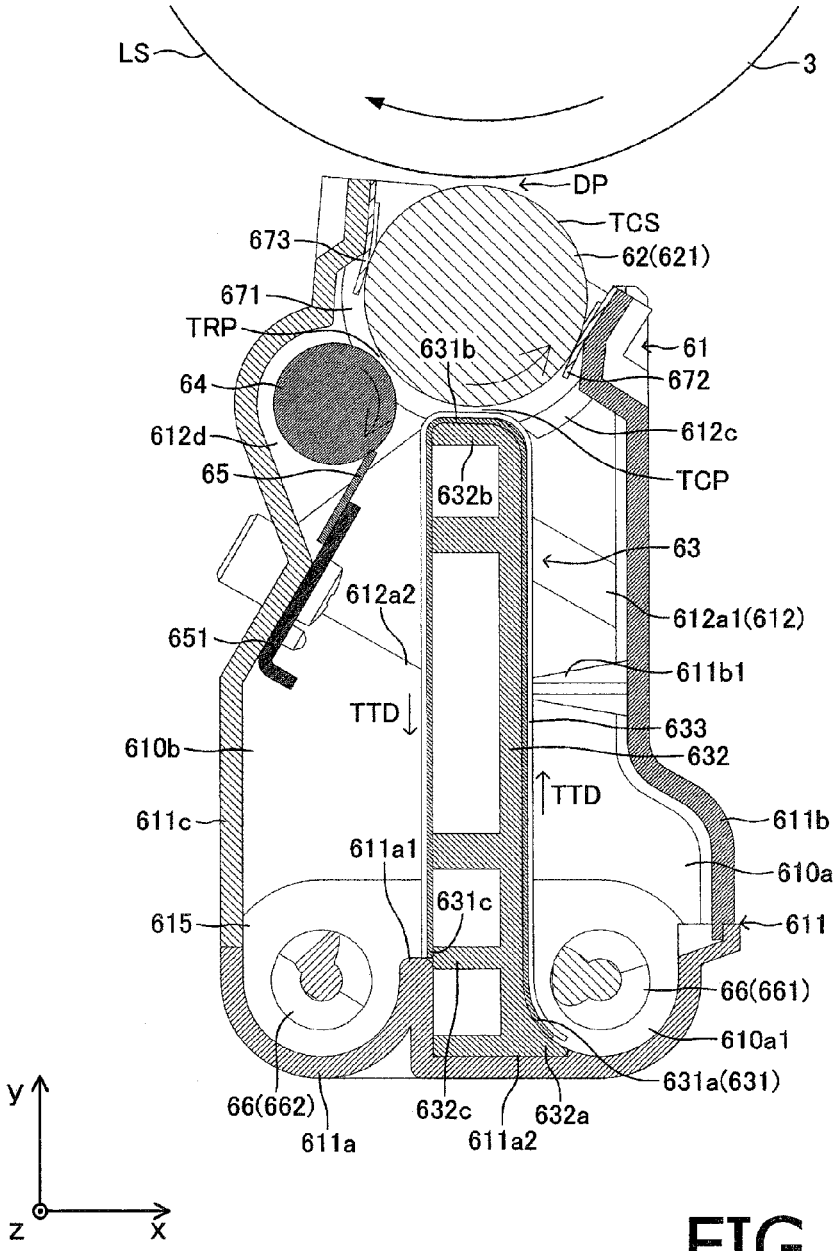
FIG. 2 is an enlarged cross-sectional side view of a toner supply device for the laser printer in the embodiment according to one or more aspects of the present invention.

As depicted in FIG. 2, which is a cross-sectional side view (along a plane with the main scanning direction as a normal line) showing the toner supply device 6 in an enlarged manner, the toner supply device 6 includes a casing 61, a development roller 62, a transfer board unit 63, a retrieving roller 64, a removing blade 65, and a toner agitating unit 66.

<<Casing>>

The casing 61 is a box-shaped member that contains therein an upstream storage section 610*a* (including an activating portion 610*a*1 at a bottom) and a downstream storage section 610*b* that are disposed adjacent to each other along a front-to-rear direction (i.e., the x-axis direction in FIG. 2). The casing 61 is configured to accommodate powdered toner in the upstream storage section 610*a* and the downstream storage section 610*b*.

The casing 61 includes a casing main body 611, which is a plate-shaped member parallel to the main scanning direction with a cross-section formed substantially in an upward-open "U" shape when viewed in the main scanning direction (the z-axis direction). The casing main body 611 includes a bottom frame 611*a* having a cross-section formed substantially in a "W" shape when viewed in the main scanning direction (the z-axis direction). Namely, there is an upward-protruding partition projection 611*a*1 provided in a position close to the center of the bottom frame 611*a* in the front-to-rear direction (i.e., the x-axis direction).

A portion (including the partition projection 611*a*1), at a side closer to the downstream storage section 610*b*, of the bottom frame 611*a* is formed substantially in a shape of an upward-open half cylinder having a central axis line parallel to the main scanning direction. An engagement groove 611*a*2 is formed along the main scanning direction, at a side closer to the upstream storage section 610*a* relative to the partition projection 611*a*1, on an upper surface of the bottom frame 611*a*. The engagement groove 611*a*2 is formed to engage with a bottom portion of the transfer board unit 63. A portion, at a side closer to upstream storage section 610*a* relative to the engagement groove 611*a*2, of the bottom frame 611*a* is formed substantially in an arc shape when viewed in the main scanning direction (the z-axis direction). Thereby, the activating portion 610*a*1, which is a bottom portion of the upstream storage section 610*a*, is formed with a substantially arc-shaped cross-section so as to be a substantially half-cylindrical space having a central axis line parallel to the main scanning direction when viewed in the main scanning direction (the z-axis direction).

A supply frame 611*b* is provided to extend upward from an upper end, at a side closer to the upstream storage section 610*a*, of the bottom frame 611*a*. The supply frame 611*b* includes board unit contact projections 611*b*1 provided to extend toward the transfer board unit 63. Specifically, the two board unit contact projections 611*b*1 are formed to protrude from inner wall surfaces at both ends of the supply frame 611*b* in the main scanning direction, so as to contact both ends of the transfer board unit 63 at a side closer to the upstream storage section 610*a*, respectively. Further, a retrieving frame 611*c* is provided to extend upward from an upper end, at a side closer to the downstream storage section 610*b*, of the bottom frame 611*a*.

Figure 3:
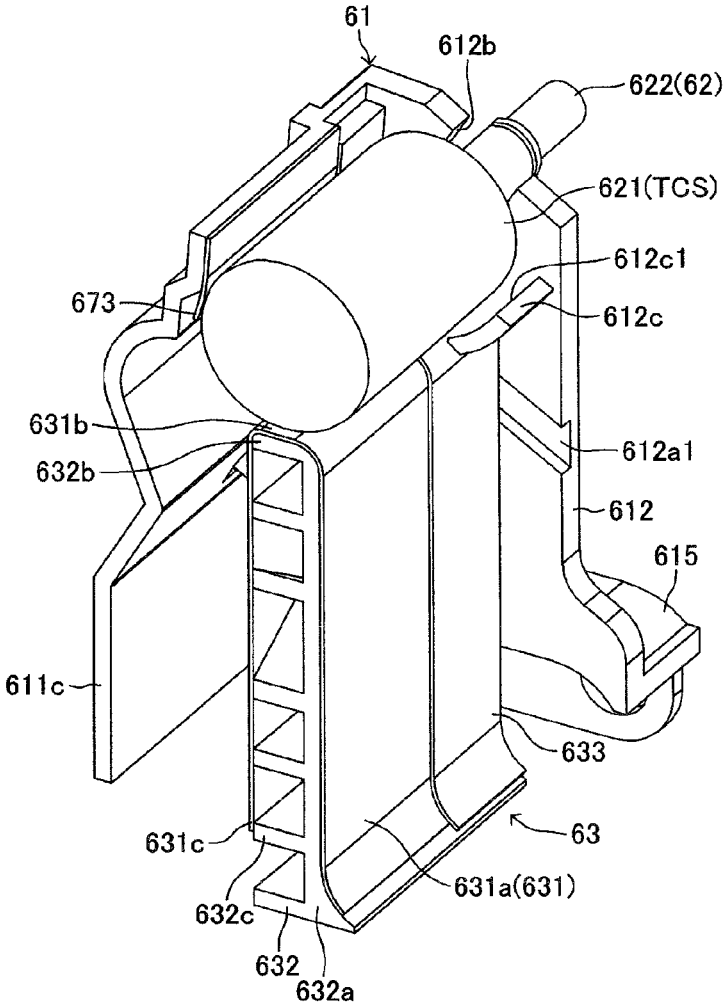
FIG. 3 is an exploded perspective view showing a part of the toner supply device in the embodiment according to one or more aspects of the present invention.
Figure 4A:
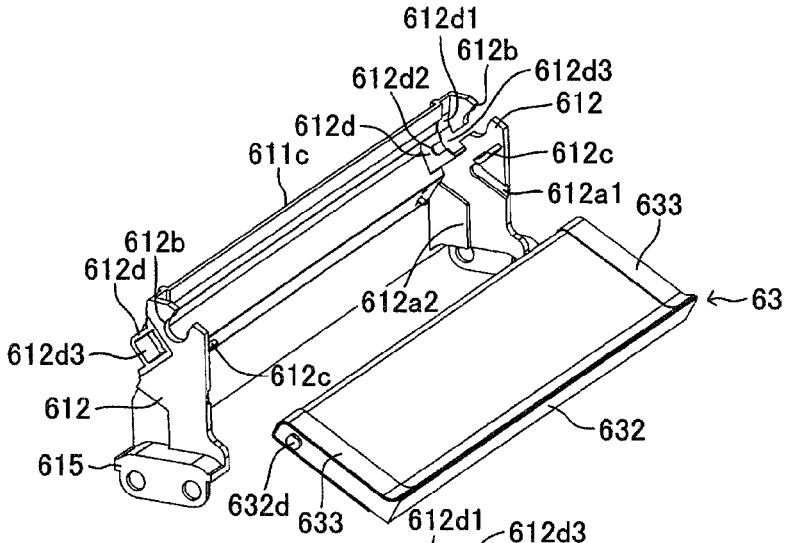
FIGS. 4A to 4C are exploded perspective views illustrating a procedure for assembling a casing of the toner supply device in the embodiment according to one or more aspects of the present invention.
Figure 4B:
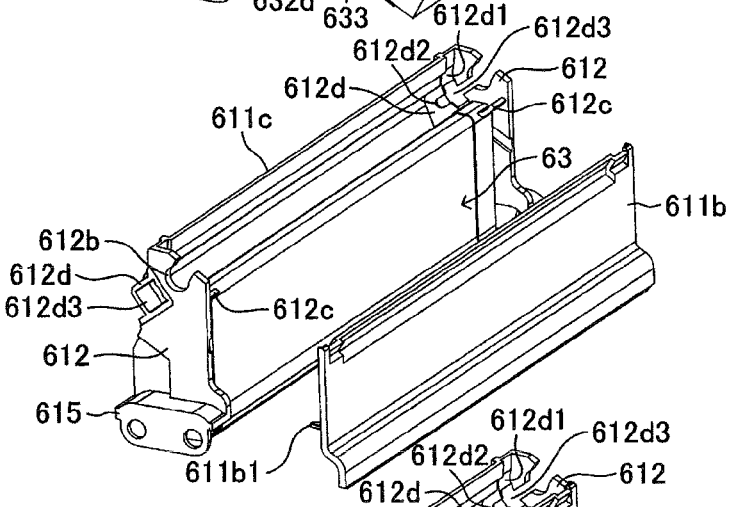
Figure 4C:
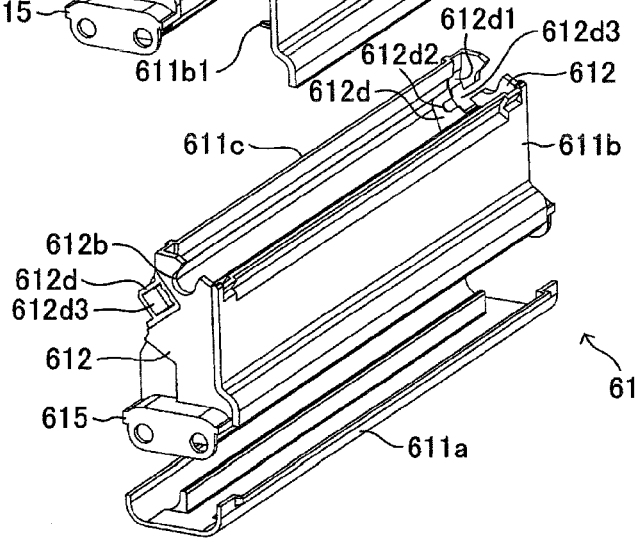
Figure 5:
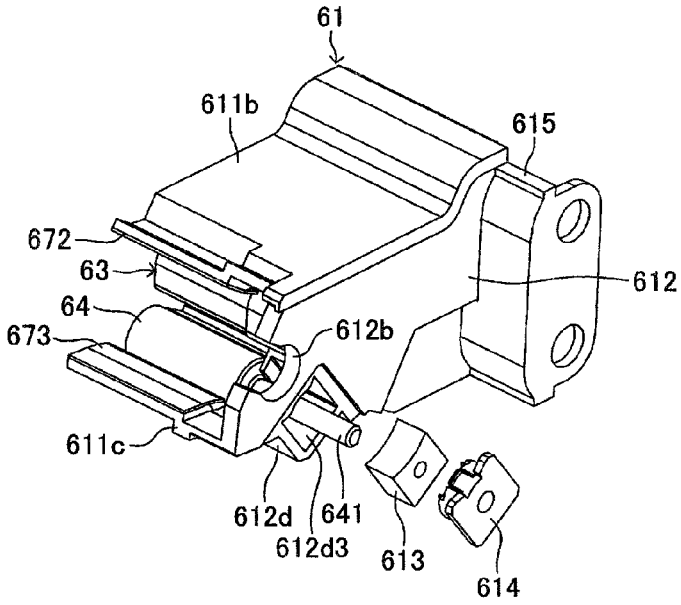
FIG. 5 is an exploded perspective view showing a part of the toner supply device in the embodiment according to one or more aspects of the present invention.

FIG. 3 is an exploded perspective view partially showing the toner supply device 6 (which shows one of the two parts into which the toner supply device 6 shown in FIG. 2 is cut along a plane perpendicular to the main scanning direction, in a position near the center of the toner supply device 6 in the main scanning direction). FIGS. 4A to 4C are exploded perspective views illustrating a procedure for assembling the casing 61 of the toner supply device 6. FIG. 5 is an exploded perspective view showing a part of the toner supply device 6.

Referring to FIGS. 2 to 5, a pair of side frames 612 is provided to shield both ends of the casing main body 611 (which has a substantially U-shaped cross-section when viewed in the main scanning direction and includes the bottom frame 611*a*, the supply frame 611*b*, and the retrieving frame 611*c*) in the main scanning direction. Each side frame 612 is formed in a flat-plate shape and disposed perpendicular to the main scanning direction. Further, a space surrounded by the casing main body 611 and the two side frames 612 are sectioned into the upstream storage section 610*a* and the downstream storage section 610*b*, by the transfer board unit 63. In addition, a portion (opening) formed with respective upper ends of the casing main body 611 and the two side frames 612 is open up toward the photoconductive drum 3.

As shown in FIGS. 3 and 4A to 4C, in the embodiment, the retrieving frame 611*c* and the two side frames 612 are formed integrally (in an inseparable fashion). Specifically, the retrieving frame 611*e* and the two side frames 612 are integrally formed from synthetic resin and configured to accommodate the transfer board unit 63. In a state housed in a board unit housing frame which is formed with the retrieving frame 611*c* and the two side frames 612, when the bottom frame 611*a* and the supply frame 611*b* are attached to the board unit housing frame, the transfer board unit 63 is housed and attached into the casing 61.

On an inner wall surface of each side frame 612, there are guide groove 612*a*1 and board unit positioning projection 612*a*2 formed to position the transfer board unit 63 in the casing 61. The guide groove 612*a*1 is a groove for guiding the transfer board unit 63 to be attached to the board unit housing frame and defining a relative positional relationship between the transfer board unit 63 and the development roller 62. The guide groove 612*a*1 extends obliquely down toward the supply frame 611*b* from a circle end, which is formed in a circle shape when viewed in the main scanning direction (the z-axis direction) and provided in an upper-side position near the center in the front-to-rear direction (the x-axis direction) on the side frame 612.

The board unit positioning projection 612*a*2 extends across a lower-side position near the center in the front-to-rear direction to the side of the retrieving frame 611*c* on the side frame 612. Each board unit positioning projection 612*a*2 protrudes inward along the main scanning direction such that an end line thereof, which extends along the up-to-down direction (the y-axis direction) near the center in the front-to-rear direction (the x-axis direction), contacts a corresponding one of both ends of the transfer board unit 63 in the main scanning direction (the z-axis direction).

At an upper end portion of the side frame 612, a development roller supporting hole 612*b* is formed to penetrate through the side frame 612 in the main scanning direction. The development roller supporting hole 612*b* is a hole (or a notched portion) for the development roller 62 to be attached and rotatably supported. The development roller supporting hole 612*b* is provided to be open upward above the upper end of the guide groove 612*a*1.

A side seal supporting rib 612*c* is formed as a plate-shaped projection extending inward along the main scanning direction from the inner wall surface of an upper side of the side frame 612. The side seal supporting rib 612*c* is disposed in a position that is above the guide groove 612*a*1, at a side closer to the upstream storage section 610*a*, and obliquely below the development roller supporting hole 612*b*. The side seal supporting rib 612*c* is disposed to face an end of a toner carrying surface TCS (i.e., a circumferential surface of the development roller 62, as will be described in detail below) in the main scanning direction in a position that is downstream relative to a toner carrying position TCP (which will be described in detail below) and upstream relative to the development position DP in a moving direction of the toner carrying surface TCS moving in response to rotation of the development roller 62.

A rib surface 612*c*1, which is a surface of the side seal supporting rib 612*c* that faces the toner carrying surface TCS, is formed in an arc shape having a common center with the development roller 62 (the toner carrying surface TCS) when viewed in the main scanning direction (the z-axis direction). Namely, the side seal supporting rib 612*c* is configured and disposed such that a constant gap is maintained between the rib surface 612*c*1 and the toner carrying surface TCS. Specifically, the side seal supporting rib 612*c* is formed as a plate-shaped arc rib having a common center with the toner carrying surface TCS when viewed in the main scanning direction.

Referring to FIGS. 4A to 4C and 5, a retrieving roller supporting portion 612*d*, which is a box-shaped projection for supporting the retrieving roller 64, protrudes inward from the inner wall surface of the side frame 612 at an upper side of the side frame 612 closer to the downstream storage section 610*b*. The retrieving roller supporting portion 612*d* is disposed obliquely below the development roller supporting hole 612*b*, so as to be adjacent to the retrieving frame 611*c*. Namely, the retrieving roller supporting portion 612*d* is disposed to face the side seal supporting rib 612*c* across a plane that contains a rotational center axis of the development roller 62 and parallel to the main scanning direction and the vertical direction.

The retrieving roller supporting portion 612*d* has an end line, facing the toner carrying surface TCS, which is formed in an arc shape that has a common center with the toner carrying surface TCS and the same curvature radius as that of the rib surface 612*c*1 when viewed in the main scanning direction. Namely, a side seal fixing portion 612*d*1, which is a surface of the retrieving roller supporting portion 612*d* that faces the toner carrying surface TCS, is formed to maintain a constant gap from the toner carrying surface TCS when viewed in the main scanning direction. It is noted that the gap between the side seal fixing portion 612*d*1 and the toner carrying surface TCS may be formed with the same distance (width) as the gap between the rib surface 612*c*1 and the toner carrying surface TCS.

The retrieving roller supporting portion 612*d* is formed with a retrieving roller shaft insertion hole 612*d*2 penetrating therethrough in the main scanning direction. Further, the retrieving roller supporting portion 612*d* is formed with a retrieving roller end seal housing hole 612*d*3. The retrieving roller end seal housing hole 612*d*3 is provided to be open toward the toner carrying surface TCS and outward along the main scanning direction from a wall surface on which the retrieving roller shaft insertion hole 612*d*2 is provided.

Referring to FIG. 5, in the retrieving roller end seal housing hole 612*d*3, a retrieving roller end seal 613 made of foamed sponge is housed. Outside the retrieving roller end seal 613 in the main scanning direction, a retrieving roller bearing 614 is disposed. The retrieving roller bearing 614 is attached to the retrieving roller supporting portion 612*d* so as to seal, from the outside, the retrieving roller end seal housing hole 612*d*3 in a state housing the retrieving roller end seal 613.

Referring back to FIGS. 2 to 5, a communication portion 615 is formed to protrude outward along the main scanning direction from a lower end of the side frame 612. The communication portion 615 is configured such that respective ends, in the main scanning direction, of the bottom portion (the activating portion 610*a*1) of the upstream storage section 610*a* and the bottom portion of the downstream storage section 610*b* communicate with each other through the communication portion 615. In other words, via the communication portion 615, the bottom portion (the activating portion 610*a*1) of the upstream storage section 610*a* and the bottom portion of the downstream storage section 610*b* are joined with each other outside the transfer board unit 63 in the main scanning direction.

Further, needless to mention, each of the two side frames 612 includes the guide groove 612*a*1, the board unit positioning projection 612*a*2, the development roller supporting hole 612*b*, the side seal supporting rib 612*c*, the retrieving roller supporting portion 612*d*, and the communication portion 615. Moreover, to each of the two side frames 612, the retrieving roller end seal 613 and the retrieving roller bearing 614 are attached.

<<<Development Roller>>>

Figure 6A:
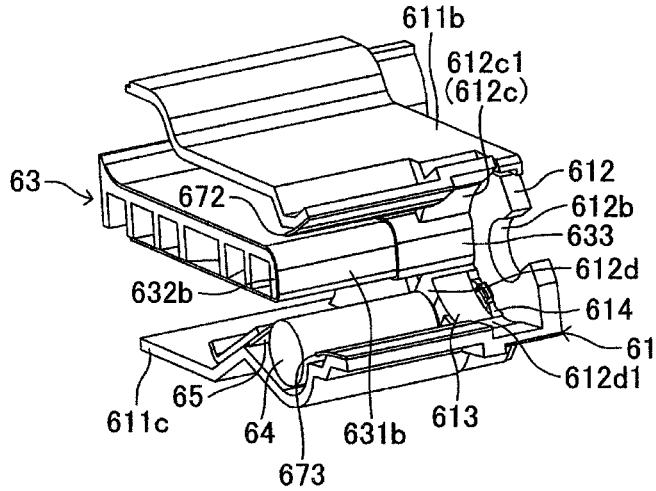
FIGS. 6A to 6C are exploded perspective views showing the toner supply device in the embodiment according to one or more aspects of the present invention.
Figure 6B:
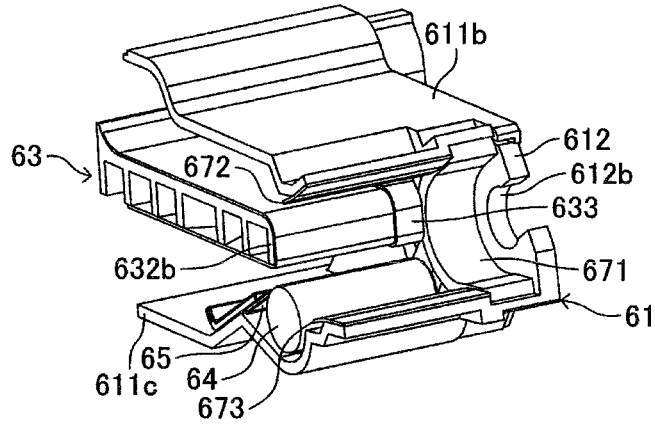
Figure 6C:
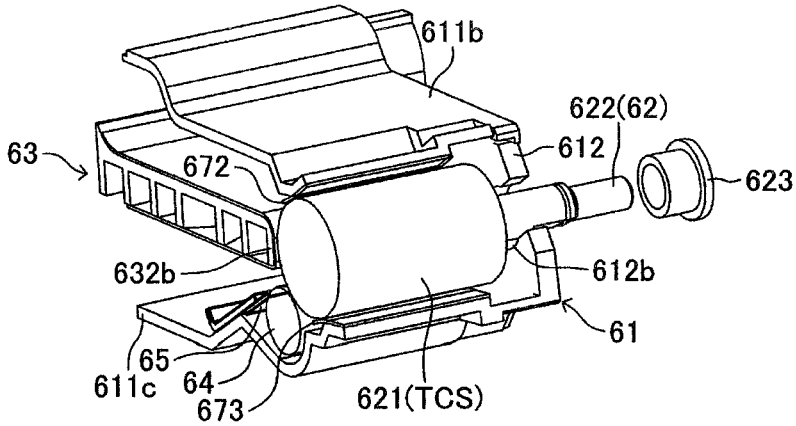

FIGS. 6A to 6C are exploded perspective views showing the toner supply device 6. Referring to FIGS. 2 to 6C, the development roller 62, which is a roller-shaped member having a development roller main body 621, is rotatably supported by the casing 61 in the vicinity of the aforementioned opening. The development roller main body 621, which is a cylindrical member, has the toner carrying surface TCS as a circumferential surface configured to carry the toner. Namely, the development roller 62 is configured to carry the toner on the toner carrying surface TCS parallel to the main scanning direction. Further, the development roller 62 is disposed such that the toner carrying surface TCS is exposed to the outside of the casing 61 via the aforementioned opening.

Specifically, a development roller shaft 622 is provided to protrude outward from both ends of the development roller main body 621 in the main scanning direction. The development roller shaft 622 is rotatably supported by (attached to) the side frame 612 via the development roller bearing 623. The development roller bearing 623, which is a substantially cylindrical member, is attached into the development roller supporting hole 612*b*. Further, the development roller 62 is configured to transfer the toner up to the development position DP by movement of the toner carrying surface TCS in a direction perpendicular to the main scanning direction in response to rotation of the development roller 62 around the development roller shaft 622 in a direction (counterclockwise as indicated by an arrow in FIG. 2) opposite to the rotational direction of the photoconductive drum 3.

<<<Transfer Board Unit>>>

The transfer board unit 63 includes an electric-field transfer board 631. The electric-field transfer board 631 is housed in the casing 61 and disposed to face the toner carrying surface TCS in the toner carrying position TCP, in order to make the toner carrying surface TCS carry the toner thereon in the vicinity of the toner carrying position TCP. Specifically, the electric-field transfer board 631 is disposed in a state curved in an upside-down "U" shape when viewed in the main scanning direction, (in a position near the center in the front-to-rear direction) inside the casing 61. Thus, the electric-field transfer board 631 is configured to transfer, under an electric field, the toner up toward a carrying position facing portion 631*b* facing the toner carrying position TCP from an upstream end 631*a* facing the activating portion 610*a*1. Further, the electric-field transfer board 631 is configured to transfer, under an electric field, the toner having passed through the toner carrying position TCP down toward a downstream end 631*c* facing the bottom portion of the downstream storage section 610*b*.

The toner carrying position TCP is a position where the toner carrying surface TCS is opposite and in closest proximity to the electric-field transfer board 631 (the transfer board unit 63 is opposite and in proximity to the development roller 62) at an upstream side relative to the development position DP in the moving direction of the toner carrying surface TCS moving in response to rotation of the development roller 62. In the embodiment, the toner carrying position TCP is disposed opposite the development position DP with respect to the rotational center axis of the development roller 62.

Figure 7:
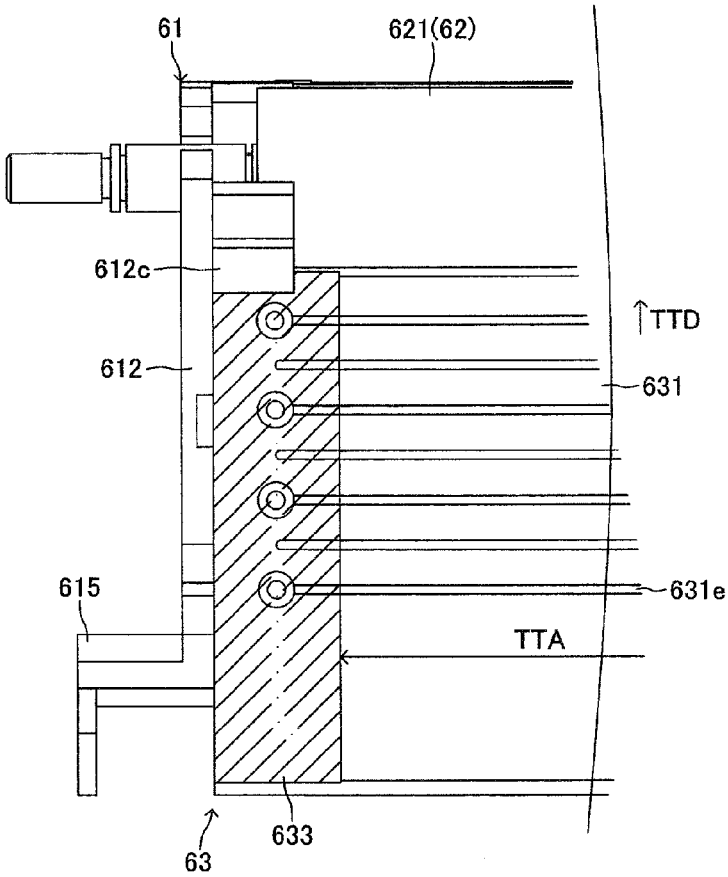
FIG. 7 is a front view of a transfer board unit for the toner supply device in the embodiment according to one or more aspects of the present invention.

FIG. 7 is a front view of the transfer board unit 63. Referring to FIG. 7, the electric-field transfer board 631 includes a plurality of transfer electrodes 631*e* having a longitudinal direction parallel to the main scanning direction. The transfer electrodes 631*e* are arranged along a toner transfer direction TTD (in which the toner is transferred by the electric-field transfer board 631) perpendicular to the main scanning direction. Referring to FIGS. 2 and 7, the electric-field transfer board 631 is configured to transfer the toner stored in the activating portion 610*a*1 toward the toner carrying position TCP and transfer the toner having passed through the toner carrying position TCP toward the bottom portion of the downstream storage section 610*b*, by a traveling-wave electric field generated when a multi-phase alternating-current (AC) voltage is applied to the transfer electrodes 631*e*.

Referring to FIGS. 2, 3, and 4A to 4C, the electric-field transfer board 631 is supported on an outer surface of a transfer board supporting member 632. The transfer board supporting member 632 is housed and supported in the casing 61 so as to extend toward the toner carrying position TCP from the bottom portions of the upstream storage section 610*a* and the downstream storage section 610*b* while a bottom portion of the transfer board supporting member 632 contacts the partition projection 611*a*1 of the bottom frame 611*a* and engages with the engagement groove 611*a*2 of the bottom frame 611*a*.

An upstream supporting portion 632*a* of the transfer board supporting member 632, which portion 632*a* supports the upstream end 631*a* of the electric-field transfer board 631, has a slope formed substantially in an arc shape when viewed in the main scanning direction as well as a portion closer to the upstream storage section 610*a* relative to the engagement groove 611*a*2 of the bottom frame 611*a*. Thereby, the activating portion 610*a*1 (the bottom portion of the upstream storage section 610*a*) is formed with a substantially arc-shaped cross-section, to be a substantially half-cylinder-shaped space having an axis line parallel to the main scanning direction when viewed in the main scanning direction.

A carrying position supporting portion 632*b* of the transfer board supporting member 632, which portion 632*b* supports the carrying position facing portion 631*b* of the electric-field transfer board 631, has a flat portion in the vicinity of the toner carrying surface TCS. Further, the carrying position supporting portion 632*b* is disposed between the side seal supporting rib 612*c* and the retrieving roller supporting portion 612*d*. Namely, the carrying position supporting portion 632*b* is disposed adjacent to the side seal supporting rib 612*c* along the moving direction of the toner carrying surface TCS moving in response to rotation of the development roller 62.

In the embodiment, the electric-field transfer board 631 is fixed to the transfer board supporting member 632 with the upstream supporting portion 632*a*, the carrying position supporting portion 632*b*, and the downstream supporting portion 632*c*. Specifically, the electric-field transfer board 631 is supported by the transfer board supporting member 632 so as to be not loose, through the following procedure. Initially, the carrying position facing portion 631*b* is fixed to the aforementioned flat portion of the carrying position supporting portion 632*b* with a double-sided adhesive tape. Subsequently, the upstream end 631*a* and the downstream end 631*c* are fixed to the upstream supporting portion 632*a* and the downstream supporting portion 632*c*, respectively, with a tension being provided to each of between the carrying position facing portion 631*b* and the upstream end 631*a* and between the carrying position facing portion 631*b* and the downstream end 631*c*.

At each of both ends, in the main scanning direction, of an upper portion of the transfer board supporting member 632, a guide projection 632*d* (see FIG. 4A) is formed to protrude outward along the main scanning direction. Each guide projection 632*d* is configured to define a relative positional relationship between the electric-field transfer board 631 and the development roller 62 in the toner carrying position TCP (to set a predetermined distance of gap between the carrying position facing portion 631*b* and the toner carrying surface TCS), when being guided by the guide groove 612*a*1 of the side frame 612 and contacting the circle end of the guide groove 612*a*.

Onto each of both ends, in the main scanning direction, of a surface of the electric-field transfer board 631, a transfer range restricting member 633 is attached over an entire length of the electric-field transfer board 631 in the toner transfer direction TTD. Referring to FIG. 7, the two transfer range restricting members 633 are disposed to form therebetween a toner transfer area TTA (an area, within which the toner is transferred, in the main scanning direction on the electric-field transfer board 631) by covering the both ends of each transfer electrode 631*e* in the main scanning direction.

<<<Configuration for Retrieving Toner>>>

Referring to FIGS. 2 and 5, the retrieving roller 64, which is a roller-shaped member (a rotational body) rotatable around an axis parallel to the main scanning direction, is disposed to face the development roller 62 across a predetermined distance of gap in a toner retrieving position TRP between the development position DP and the toner carrying position TCP (i.e., in a position downstream relative to the development position DP and upstream relative to the toner carrying position TCP) in the moving direction of the toner carrying surface TCS moving in response to rotation of the development roller 62. Namely, the retrieving roller 64 is disposed in a position corresponding to an upper end of the downstream storage section 610*b*. The retrieving roller 61 is configured to retrieve the toner from the toner carrying surface TCS in the vicinity of the toner retrieving position TRP when a predetermined retrieving bias is applied between the retrieving roller 64 and the development roller 62.

The retrieving roller 64 is rotatably supported by each side frame 612, when the retrieving roller bearing 614 is attached to the side frame 612 so as to seal the retrieving roller end seal housing hole 612*d*3, in a state where a retrieving roller shaft 641 (which forms a rotational center axis of the retrieving roller 64) is inserted, through the retrieving roller end seal 613, into the retrieving roller bearing 614. In the embodiment, the retrieving roller 64 is driven to rotate in a direction opposite to the rotational direction of the development roller 62 such that a moving direction of a circumferential surface thereof is identical, in the toner retrieving position TRP, to the moving direction of the toner carrying surface TCS moving in response to rotation of the development roller 62.

Beneath the retrieving roller 64, the removing blade 65 is disposed to slide in contact with the circumferential surface of the retrieving roller 64 at a downstream side relative to the toner retrieving position TRP in the moving direction of the circumferential surface of the retrieving roller 64. The removing blade 65 is supported by the retrieving frame 611*c* via a blade holder 651. The removing blade 65 is configured to remove the toner retrieved from the toner carrying surface TCS by the retrieving roller 64, from the circumferential surface of the retrieving roller 64 and make the removed toner drop toward the bottom portion of the downstream storage section 610*b*.

<<<Configuration for Agitating Toner>>>

The toner agitating unit 66 is disposed in the bottom portion of the casing 61, so as to agitate the toner stored in the bottom portions of the upstream storage section 610*a* and the downstream storage section 610*b* and circulate the toner between the upstream storage section 610*a* and the downstream storage section 610*b*. Specifically, the toner agitating unit 66 includes an activating auger 661 and a retrieving auger 662.

The activating auger 661, which is a known rod-shaped auger screw, is provided over an entire length of the bottom portion of the upstream storage section 610*a*, i.e., the activating portion 610*a*1 in the main scanning direction. The retrieving auger 662, which is an auger screw formed in the same shape as the activating auger 661, is disposed parallel to the activating auger 661. The activating auger 661 and the retrieving auger 662 are rotatably supported by the communication portion 615. Further, the activating auger 661 and the retrieving auger 662 are linked with each other via one or more gears (not shown) so as to rotate in respective different directions.

<<<Toner Seal Member>>>

As illustrated in FIGS. 2 to 6C, in order to prevent the toner from leaking to the outside, side seal members 671, a supply seal plate 672, and a retrieving seal plate 673 are attached to the casing 61, as well as the retrieving roller end seal 613 is.

Each side seal member 671 is configured to slide in contact with a corresponding one of both ends of the toner carrying surface TCS in the main scanning direction while filling in a gap between the casing 61 and the end of the toner carrying surface TCS (the development roller main body 621) in the main scanning direction, so as to prevent the toner from leaking to the outside of the casing 61 via the gap. The side seal member 671 has a known configuration (e.g., a laminated structure of a foamed sponge and a felt).

The side seal member 671 is disposed to extend across the rib surface 612*c*1 of the side seal supporting rib 612*c*, a portion of the carrying position supporting portion 632*b* at which portion the transfer range restricting member 633 is disposed, the retrieving roller end seal 613, and the side seal fixing portion 612*d*1 of the retrieving roller supporting portion 612*d*. Specifically, the side seal member 671 is fixed with a double-sided adhesive tape to extend across the rib surface 612*c*1 of the side seal supporting rib 612*c*, a portion of the carrying position supporting portion 632*b* at which portion the transfer range restricting member 633 is disposed, the retrieving roller end seal 613, and the side seal fixing portion 612*d*1 of the retrieving roller supporting portion 612*d*.

As shown in FIGS. 6A to 6C, and 7, the side seal member 671 is disposed outside an inside end line (which defines the toner transfer area TTA) of the transfer range restricting member 633 in the main scanning direction. Namely, in the embodiment, the side seal member 671 is disposed outside the toner transfer area TTA, within which the toner is transferred in the main scanning direction on the electric-field transfer board 631.

Referring back to FIGS. 2 to 6C, the supply seal plate 672 is attached, with a double-sided adhesive tape, onto an inner wall surface of an upper end portion of the supply frame 611*b*. In the same manner, the retrieving seal plate 673 is attached, with a double-sided adhesive tape, onto an inner wall surface (which faces the toner carrying surface TCS) of an upper end portion of the retrieving frame 611*c*. Each of the supply seal plate 672 and the retrieving seal plate 673 is a thin plate member made of synthetic resin such as polyethylene terephthalate (PET), and disposed to extend across one of the two side seal members 671 to the other along the main scanning direction.

<Operations of Laser Printer>

Subsequently, a general overview will be provided of operations of the laser printer 1 configured as above with reference to the relevant drawings.

<<Sheet Feeding Operation>>

Referring to FIG. 1, firstly, a leading end of a sheet P placed on the feed tray (not shown) is fed to the registration rollers 21. The registration rollers 21 perform skew correction for the sheet P, and adjust a moment when the sheet P is to be fed forward. After that, the sheet P is fed to the transfer position TP.

<<Formation of Toner Image on Electrostatic Latent Image Holding Surface>>

While the sheet P is being conveyed to the transfer position TP as described above, an image of the toner (hereinafter referred to as a toner image) is formed on the electrostatic latent image carrying surface LS that is the circumferential surface of the photoconductive drum 3, as will be mentioned below.

<<Formation of Electrostatic Latent Image>>

Firstly, the electrostatic latent image carrying surface LS of the photoconductive drum 3 is charged evenly and positively by the electrification device 4. The electrostatic latent image carrying surface LS, charged by the electrification device 4, is moved along the auxiliary scanning direction to the scanned position SP to face the scanning unit 5, when the photoconductive drum 3 rotates in the direction (clockwise in FIG. 1) indicated by arrows in FIG. 1.

In the scanned position SP, the electrostatic latent image carrying surface LS is exposed to the laser beam LB modulated based on the image data. Namely, while being scanned along the main scanning direction, the laser beam LB is rendered incident onto the electrostatic latent image carrying surface LS. In accordance with the modulation of the laser beam LB, areas with (substantially) no positive charges remaining thereon are generated on the electrostatic latent image carrying surface LS. Thereby, an electrostatic latent image is formed with a positive charge pattern (positive charges distributed in the shape of an image) on the electrostatic latent image carrying surface LS. The electrostatic latent image, formed on the electrostatic latent image carrying surface LS, is transferred to the development position DP to face the toner supply device 6 when the photoconductive drum 3 rotates in the direction (clockwise in FIG. 1) indicated by the arrows in FIG. 1.

<<Transfer and Supply of Charged Toner>>

Referring to FIG. 2, the toner stored in the activating portion 610*a*1 is charged due to contact and/or friction with the electric-field transfer board 631. The charged toner is conveyed in the toner transfer direction TTD, by the traveling-wave electric field generated when the transfer bias, containing the multi-phase AC voltage component, is applied to the electric-field transfer board 631 (the transfer electrodes 631*e* shown in FIG. 7).

The toner, immediately after leaving the activating portion 610*a*1, might contain toner charged in an undesired manner as well (such as negatively charged toner, inadequately charged toner, and uncharged toner). Nonetheless, in the embodiment, inappropriately charged toner drops down off a vertically-extending toner transfer path by the action of the gravity, when being conveyed vertically up toward the toner carrying position TCP from the activating portion 610*a*1 by the electric-field transfer board 631. Thereby, it is possible to selectively convey adequately charged toner to the toner carrying position TCP.

The toner, transferred up to the toner carrying position TCP, is held and carried on the toner carrying surface TCS in the vicinity of the toner carrying position TCP. The toner, which has passed through the toner carrying position TCP without being carried on the toner carrying surface TCS, is conveyed to the downstream storage section 610*b*.

When the toner carrying surface TCS carrying the toner moves up to the development position DP in response to the development roller 62 being driven to rotate, the toner is supplied to the development position DP. In the vicinity of the development position DP, the electrostatic latent image formed on the electrostatic latent image carrying surface LS is developed with the toner. Namely, the toner is transferred from the toner carrying surface TCS to adhere to the areas with no positive charge on the electrostatic latent image carrying surface LS. Thereby, the toner image (i.e., the image of the toner) is formed and carried on the electrostatic latent image carrying surface LS.

The toner carried on the toner carrying surface TCS, which toner has passed through the development position DP (without being consumed in the development position DP), reaches (the vicinity of) the toner retrieving position TRP in response to rotation of the development roller 62. In the vicinity of the toner retrieving position TRP, the toner is retrieved by the toner retrieving roller 64.

At this time, the retrieving roller 64 rotates in non-contact with the toner carrying surface TCS while retrieving the toner from toner carrying surface TSC. Hence, a portion, which faces the toner retrieving position TRP, of the circumferential surface of the retrieving roller 64 moves in response to rotation of the retrieving roller 64 without sliding in contact with the toner carrying surface TCS. The toner adhering to the circumferential surface of the retrieving roller 64 is removed by the removing blade 65, and falls into the bottom portion of the downstream storage section 610*b*. Accordingly, such areas on the circumferential surface of the retrieving roller 64 that the toner adhering thereto is reduced or completely removed are sequentially supplied to the toner retrieving position TRP. In addition, it is possible to prevent an undesired situation where there is toner improperly left (to form an undesired toner adhering pattern) on the toner carrying surface TCS due to contact and/or sliding in contact between the retrieving roller and the toner.

In the meantime, the toner, which reaches the vicinity of the toner carrying position TCP, is charged enough to be conveyed up to the toner carrying position TCP under the electric field generated by the electric transfer board 631. Further, there may be a case where while being conveyed to the vicinity of the toner carrying position TCP by the electric-field transfer board 631, the toner is charged up due to collision and/or friction with the surface of the electric-field transfer board 631.

Therefore, the toner having passed through the toner carrying position TCP without being carried on the toner carrying surface TCS and the toner retrieved by the retrieving roller 64 and removed by the removing blade 65 after once carried on the toner carrying surface TCS (hereinafter referred to as "the toner having passed through the toner carrying position TCP" in a generic manner) are at relatively high charged levels. When such toner is returned as is into the upstream storage section 610*a* (the activating portion 610*a*1), the toner might be aggregated together by the action of the charges (the electrostatic forces) in the activating portion 610*a*1.

To avoid the aggregation of the toner, in the embodiment, the toner having passed through the toner carrying position TCP is once held in the downstream storage section 610*b* before returned into the upstream storage section 610*a* (the activating portion 610*a*1). Then, the toner, once held in the downstream storage section 610*b*, is returned into the upstream storage section 610*a* by the toner agitating unit 66. Thereby, it is possible to prevent in a favorable manner the aggregation of the toner that might be caused when the toner having passed through the toner carrying position TCP is returned as is directly into the upstream storage section 610*a*.

One of possible reasons why the aggregation of the toner can be prevented is considered to be as follows: the relatively high charged level of the toner having passed through the toner carrying position TCP is brought down to such a lower level that the toner is not aggregated in the upstream storage section 610*a*, while being held in the downstream storage section 610*b*.

Thus, in the embodiment, it is possible to prevent the aggregation of the toner that might be caused when the toner having passed through the toner carrying position TCP is returned as is directly into the upstream storage section 610*a*. Thus, it is possible to stably supply the charged toner.

<<Transfer of Toner Image from Electrostatic Latent Image Holding Surface onto Sheet>>

Referring to FIG. 1, the toner image, which is carried on the electrostatic latent image carrying surface LS of the photoconductive drum 3 as described above, is conveyed to the transfer position TP when the electrostatic latent image carrying surface LS turns in the direction shown by the arrows in FIG. 1. Then, in the transfer position TP, the toner image is transferred from the electrostatic latent image carrying surface LS onto the sheet P.

<General Overview of Process of Assembling Toner Supply Device>

Next, referring to the relevant drawings, an explanation will be provided about a process of assembling the toner supply device 6 configured as above (i.e., a process of attaching, to the casing 61, the development roller 62, the transfer board unit 63, the retrieving roller 64, and the side seal member 671).

Referring to FIGS. 2 and 3, in the embodiment, firstly, the carrying position facing portion 631*b* is fixed to the aforementioned flat portion of the carrying position supporting portion 632*b* with a double-sided adhesive tape. After that, the upstream end 631*a* is fixed to the upstream supporting portion 632*a* with a tension being provided between the carrying position facing portion 631*b* and the upstream end 631*a*. Further, the downstream end 631*c* is fixed to the downstream supporting portion 632*c* with a tension being provided between the carrying position facing portion 631*b* and the downstream end 631*c*. Thereby, the electric-field transfer board 631 is supported by the transfer board supporting member 632, in such a favorable manner as to be not loose. Thereafter, onto each of the both ends, in the main scanning direction, of the surface of the electric-field transfer board 631, the transfer range restricting member 633 is attached over the entire length of the electric-field transfer board 631 in the toner transfer direction TTD.

The transfer board unit 63 assembled as above is inserted into the board unit housing frame formed integrally with the retrieving frame 611*c* and the two side frames 612, with a leading end as a side of the transfer board unit 63 closer to the guide projections 632*d* as shown in FIG. 4A (i.e., with a leading end as a side of the transfer board unit 63 closer to the carrying position facing portion 631*b* and the carrying position supporting portion 632*b* shown in FIG. 3). Then, the guide projections 632*d* are guided by the guide grooves 612*a*1 of the side frames 612, respectively. Thereafter, when the guide projections 632*d* contact the circle ends of the guide grooves 612*a*1, respectively, and the board unit positioning projections 612*a*2 of the side frames 612 contact the both ends of the transfer board unit 63 in the main scanning direction, respectively, the transfer board unit 63 is housed in the board unit housing frame, as illustrated in FIG. 4B.

As depicted in FIG. 4B, in a state where the transfer board unit 63 is housed in the board unit housing frame, the supply frame 611*b* is attached to the board unit housing frame. At this time, when the two board unit contact projections 611*b*1, which are respectively formed to protrude from the both ends of the inner wall surface of the supply frame 611*b* in the main scanning direction, contact the both ends of the transfer board unit 63 in the main scanning direction, respectively, the transfer board unit 63 is pressed against the board unit positioning projections 612*a*2.

In this state, as illustrated in FIG. 4C, the bottom frame 611*a* is attached to the board unit housing frame from beneath. At this time, as shown in FIG. 2, the lower end portion of the transfer board supporting member 632 contacts the partition projection 611*a*1 of the bottom frame 611*a* to be engaged with and locked by the engagement groove 611*a*2. Thereby, the transfer board unit 63 is pressed upward such that the guide projections 632*d* (see FIG. 4A) certainly contact the circle ends of the guide grooves 612*a*1. Thus, the transfer board unit 63 is attached to the casing 61.

As illustrated in FIG. 5, in a state where the retrieving roller 64 is attached in a predetermined position (a position corresponding to the retrieving roller supporting portion 612*d*) inside the casing 61, the retrieving roller shaft 641 is inserted, through the retrieving roller end seals 613, into the retrieving roller bearings 614. Further, each retrieving roller end seal 613 is housed in the retrieving roller end seal housing hole 612*d*3, and each retrieving roller bearing 614 is attached to the retrieving roller supporting portion 612*d* to seal the retrieving roller end seal housing hole 612*d*3 from the outside. Thereby, the retrieving roller 64 is rotatably attached to the casing 61.

As shown in FIG. 6A, in a state where the transfer board unit 63, the retrieving roller 64, the supply seal plate 672, and the retrieving seal plate 673 is attached to the casing 61, each side seal member 671 is attached via a double-sided adhesive tape so as to extend across the rib surface 612*c*1 of the side seal supporting rib 612*c*, the transfer range restricting member 633, the retrieving roller end seal 613, and the side seal fixing portion 612*d*1 of the retrieving roller supporting portion 612*d* (see FIG. 6B). At this time, the side seal member 671 is disposed outside the toner transfer area TTA (see FIG. 7). After that, the development roller shaft 622 is inserted into the development roller bearings 623, and each development roller bearing 623 is attached to the development roller supporting hole 612*b*. Thereby, the development roller 62 is rotatably attached to the casing 61.

<Operations and Effects in Embodiment>

Subsequently, an explanation will be provided about operations and effects that are brought by the toner supply device 6 configured as above in the embodiment, with reference to the relevant drawings.

As described above, in the state where the development roller 62, the transfer board unit 63 the retrieving roller 64, and the side seal members 671 are attached to the casing 61, the relative positional relationship between the electric-field transfer board 631 and the development roller 62 in the toner carrying position TCP (the predetermined distance of gap between the carrying position facing portion 631*b* and the toner carrying surface TCS) is determined in a favorable manner with the guide projections 632*d* provided to the transfer board unit 63, the guide groove 612*a*1 and the development roller supporting hole 612*b* provided to each side frame 612, and the development roller bearing 623.

Further, in the aforementioned state, in a position corresponding to each end of the development roller main body 621 in the main scanning direction, the side seal member 671 is attached to extend across the rib surface 612*c*1 of the side seal supporting rib 612*c*, the portion of the carrying position supporting portion 632*b* at which portion the transfer range restricting member 633 is disposed, the retrieving roller end seal 613, and the side seal fixing portion 612*d*1 of the retrieving roller supporting portion 612*d*. The side seal member 671 is configured to, when the toner supply device 6 operates, slide in contact with the toner carrying surface TCS at each end of the development roller main body 621 in the main scanning direction while filling the gap between the toner carrying surface TCS and the casing 61 at each end of the development roller main body 621 in the main scanning direction. Accordingly, it is possible to prevent the toner from leaking from the gap between the toner carrying surface TCS and the casing 61 at each end of the development roller main body 621 in the main scanning direction.

In the embodiment, the side seal supporting rib 612*c*, which is disposed to be concentric with the development roller main body 621 when viewed in the main scanning direction, is formed to protrude inward from the inner wall surface of each side frame 612. Further, the rib surface 612*c*1 of the side seal supporting rib 612*c*, the portion of the carrying position supporting portion 632*b* at which portion the transfer range restricting member 633 is disposed, the retrieving roller end seal 613, and the side seal fixing portion 612*d*1 of the retrieving roller supporting portion 612*d* are arranged along the moving direction of the toner carrying surface TCS moving in response to rotation of the development roller 62. Moreover, the side seal fixing portion 612*d*1, which is a surface of the retrieving roller supporting portion 612*d* that faces the toner carrying surface TCS, is formed in an arc shape that has a common center with the development roller main body 621 and the same curvature radius as the rib surface 612*c*1 when viewed in the main scanning direction. Accordingly, each side seal member 671 is attached in a stable and simple manner.

Further, the side seal members 671 are disposed outside the toner transfer area TTA (the area, within which the toner is effectively transferred, in the main scanning direction on the electric-field transfer board 631). Therefore, it is possible to reduce, as effectively as practicable, the amount of toner to inflow into a sliding contact interface between the toner carrying surface TCS and the side seal members 671. Thus, it is possible to prevent the toner from leaking to the outside via the aforementioned gaps.

The electric-field transfer board 631 is fixed to the carrying position supporting portion 632*b* at the carrying position facing portion 631*b* thereof that faces the carrying position supporting portion 632*b*. Further, the electric-field transfer board 631 is supported by the transfer board supporting member 632, with a tension being provided to between the carrying position facing portion 631*b* and each end of the electric-field transfer board 631 in the toner transfer direction TTD (i.e., between the carrying position facing portion 631*b* and the upstream end 631*a* and between the carrying position facing portion 631*b* and the downstream end 631*c*). Thereby, it is possible to prevent the electric-field transfer board 631 from being loose, in a favorable manner.

Hereinabove, the embodiment according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications are feasible.

Aspects of the present invention may be applied to electrophotographic image forming devices such as color laser printers, and monochrome and color copy machines, as well as the single-color laser printer as exemplified in the aforementioned embodiment. Further, the photoconductive body is not limited to the drum-shaped one as exemplified in the aforementioned embodiment. For instance, the photoconductive body may be formed in the shape of a plate or an endless belt.

Additionally, light sources (e.g., LEDs, electroluminescence devices, and fluorescent substances) other than a laser scanner may be employed as light sources for exposure. In such cases, the "main scanning direction" may be parallel to a direction in which light emitting elements such as LEDs are aligned. Namely, the "main scanning direction" may be referred to as a "sheet width direction" (a direction always perpendicular to a sheet feeding direction) or a "device width direction."

Alternatively, aspects of the present invention may be applied to image forming devices employing methods other than the aforementioned electrophotographic method (e.g., a toner-jet method using no photoconductive body, an ion flow method, and a multi-stylus electrode method).

Figure 8:
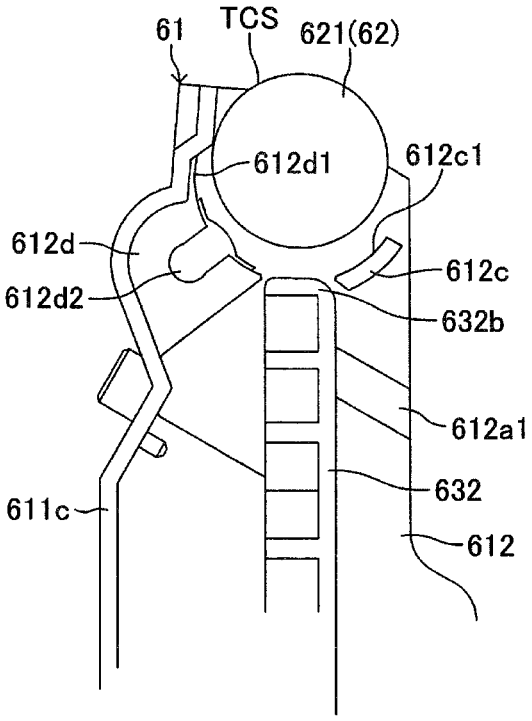
FIG. 8 is a cross-sectional side view schematically showing a part of a toner supply device in a modification according to one or more aspects of the present invention.

The board unit contact projections 611*b*1 may be in contact with the transfer range restricting members 633, with the electric-field transfer board 631, or with the transfer board supporting member 632. Namely, there may be portions, on which the electric-field transfer board 631 and/or the transfer range restricting members 633 are not provided, formed in areas, with which the board unit contact projections 611*b* are in contact with, on outer wall surfaces of the both ends of the transfer board unit 63 in the main scanning direction, FIG. 8 is an exploded side view schematically showing (a part of) a configuration of a toner supply device 6 in a modification according to aspects of the present invention. As shown in FIG. 8, the rib surfaces 612*c*1 of the side seal supporting ribs 612*c*, the carrying position supporting portion 632*b*, and the side seal fixing portions 612*d*1 of the retrieving roller supporting portions 612*d* may be provided to keep a substantially constant distance from the rotational center axis of the development roller 62.

In such a configuration, a distance between each side seal supporting rib 612*c* and the toner carrying surface TCS, a distance between each transfer range restricting member 633, a distance between each retrieving roller end seal 613 and the toner carrying surface TCS, and a distance between the side seal fixing portion 612*d*1 of each retrieving roller supporting portion 612*d* are substantially identical to each other. Thereby, each side seal member 671 is supported by a smooth shape formed along the (cylindrical-surface-shaped) toner carrying surface TCS when viewed in the main scanning direction. Accordingly, it is possible to stably set the side seal members 671 and to make the side seal members 671 in closer contact with the toner carrying surface TCS.

The retrieving roller supporting portions 612*d* may be included in the retrieving frame 611*c*, instead of being included in the side frames 612. Further, each side frame 612 may be configured without one or both of the retrieving roller supporting portion 612*d* and the communication portion 615. Namely, each side frame 612 may be configured as a completely-flat plate member.

Figure 9A:
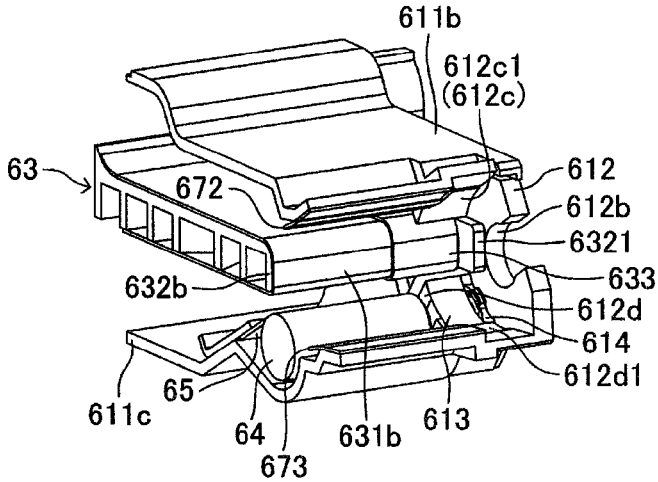
FIGS. 9A to 9C are exploded perspective views showing a toner supply device in another modification according to one or more aspects of the present invention.
Figure 9B:
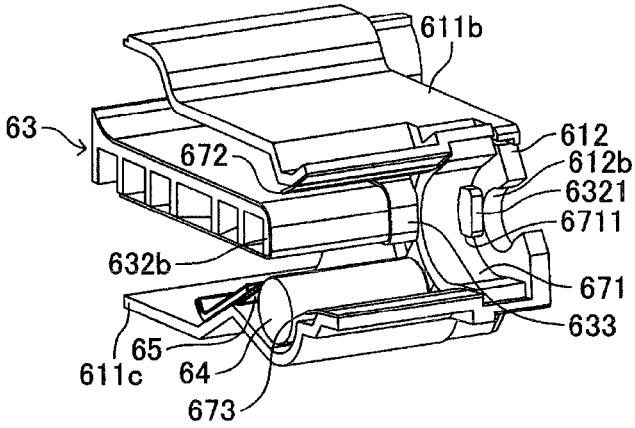
Figure 9C:
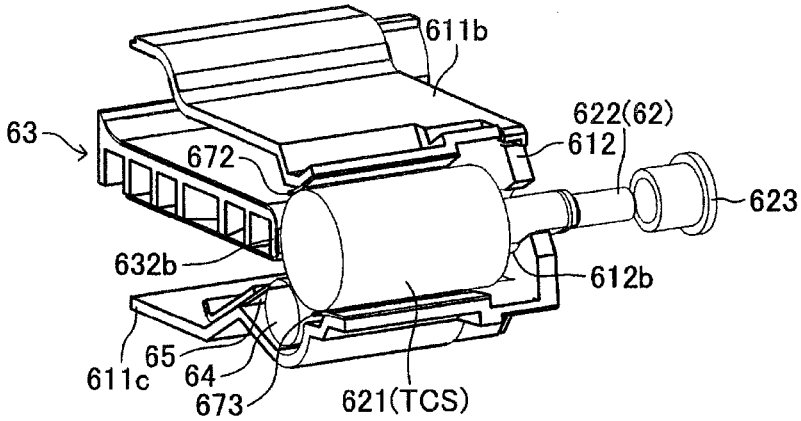

FIGS. 9A to 9C are exploded perspective views schematically showing a configuration of a toner supply device 6 in another modification according to aspect of the present invention. As illustrated in FIGS. 9A to 9C, there is a gap defining projection 6321 formed to protrude toward the development roller shaft 622 from each of the both ends of the carrying position facing portion 631*b* in the main scanning direction. Each gap defining projection 6321 may be configured to, when penetrating through a notched portion 6711 provided to the side seal member 671 and contacting the development roller bearing 623, define a relative positional relationship between the electric-field transfer board 631 and the development roller 62 in the toner carrying position TCP (i.e., set a predetermined distance of gap between the carrying position facing portion 631*b* and the toner carrying surface TCS).

According to the toner supply device 6 of the modification, it is possible to define the relative positional relationship in a simple and certain manner. Further, it is noted that in this case, the toner supply device 6 may be configured without the guide grooves 612*a*1 of the side frames 612 or the guide projections 632*d* of the transfer board supporting member 632.

The casing main body 611, which is formed with a substantially U-shaped cross-section when viewed in the main scanning direction, may be formed integrally with the bottom frame 611*a*, the supply frame 611*b*, and the retrieving frame 611*c* in a seamless manner. Alternatively, the tube-shaped board unit housing frame, which includes the supply frame 611*b*, the retrieving frame 611*c*, and the two side frames 612, may be formed integrally in a seamless manner. In these cases, each guide groove 612*a*1 may be formed to extend downward from the development roller supporting hole 612*b*. Further, the configuration as illustrated in FIGS. 9A to 9C may be employed. Furthermore, the configuration of the casing 61 may be flexibly modified within the scope of the inventive concept as expressed herein.

The development roller 62 may be disposed to form a predetermined distance of gap between the toner carrying surface TCS and the electrostatic latent image carrying surface LS in the development position DP. Alternatively, the development roller 62 may be disposed such that the toner carrying surface TCS contacts the electrostatic latent image carrying surface LS in the development position DR Further, the development roller 62 may be replaced with a sleeve-shaped one. Namely, the development roller 62 may be configured with a sleeve-shaped member and a roller-shaped member inserted into the sleeve-shaped member. In this case, the roller-shaped member may be made of rubber or sponge.

When it is assumed that the toner is efficiently transferred to be carried on the toner carrying surface TCS in the toner carrying position TCP and there is hardly toner left to be conveyed on the electric-field transfer board 631 toward the downstream storage section 610*b* after passing through the toner carrying position TCP, the toner supply device 6 may be configured without the transfer electrodes 631*e* in the flat-plate portion, which faces the downstream storage section 610*b*, of the electric-field transfer board 631. Alternatively, the toner supply device 6 may be configured without the flat-plate portion.

Further, instead of the removing blade 65, a brush roller may be employed to remove the toner from the retrieving roller 64. Moreover, instead of the retrieving roller 64, a blade member similar to the removing blade 65 or a brush roller may be employed.

Further, the electric-field transfer board 631 may be divided into two sections, i.e., an upstream section and a downstream section with respect to the toner carrying position TCP. Further, different direct-current (DC) bias voltages may be applied to the upstream section and the downstream section, respectively. In this case, the retrieving roller 64 may be disposed to closely face the downstream section across a predetermined distance of gap. Thereby, the toner is retrieved from the retrieving roller 64 by the downstream section. Alternatively, the toner supply device 6 may be configured without the retrieving roller 64, such that the toner is retrieved from the toner carrying surface TCS by the downstream section.

The side seal members 671 may be disposed such that the inner end lines thereof in the main scanning direction correspond to the outer end lines of the toner transfer area TTA in the main scanning direction, respectively. Namely, the transfer range restricting members 633 and the side seal members 671 may be configured and disposed such that the inner end lines of the transfer range restricting members 633 in the main scanning direction correspond to the inner end lines of the side seal members 671 in the main scanning direction, respectively.

The toner supply device 6 may be configured without the transfer range restricting members 633. In this case, the side seal members 671 may directly contact or be attached with the electric-field transfer board 631 or the transfer board supporting member 632.

The toner supply device 6 may not necessarily be configured such that the toner is transferred vertically up toward (the vicinity of) the toner carrying position TCP as exemplified in the aforementioned embodiment. For instance, the electric-field transfer board 631 may be configured to have an upstream section (i.e., a flat-plate section between the upstream end 631*a* and the carrying position facing portion 631*b*) for transferring the toner toward (the vicinity of) the toner carrying position TCP, which upstream section has a down-facing toner transfer surface on which the toner is transferred.

Specifically, the electric-field transfer board 631 configured with the upstream section having the down-facing toner transfer surface may be realized when the toner supply device 6 shown in FIG. 2 is rotated clockwise by an angle of 10 to 90 degrees and the upstream end 631*a* of the electric-field transfer board 631 is disposed at the lowest end of the activating portion 610*a*1. In this case, the configurations of other elements such as the casing 61 and the toner agitating unit 66 may be changed appropriately as needed from those as shown in FIG. 2.

What is claimed is:

1. A developer supply device configured to supply charged development agent to an intended device, comprising:

a roller-shaped developer carrying member comprising:

a cylindrical roller main body having a developer carrying surface that is formed as a cylindrical circumferential surface parallel to a first direction and configured to carry the development agent; and a shaft that protrudes outward from both ends of the roller main body in the first direction, the developer carrying member being configured to rotate around the shaft such that the developer carrying surface moves in a second direction perpendicular to the first direction to transfer the development agent carried thereon to a first position where the developer carrying surface faces the intended device;

a casing comprising:

a casing main body formed as a U-shaped plate member having a substantially U-shaped cross-section along a plane perpendicular to the first direction;

side frames that are formed as flat plate members and disposed on both sides of the casing main body in the first direction, respectively, and side seal supporting ribs each of which is formed concentrically with the roller main body when viewed in the first direction and protrudes inward from an inner wall surface of one of the side frames, each of the side seal supporting ribs has a rib surface facing one of the both ends of the developer carrying surface in the first direction, and each of the side seal members is disposed to extend across the rib surface as the casing-side facing portion and the supporting-member-side facing portion, the casing main body and the side frames forming, inside a space surrounded thereby, a developer storage section configured to accommodate the development agent, the casing being configured to rotatably support the developer carrying member by the side frames at an opening of the U-shaped casing main body;

a transfer board comprising a plurality of transfer electrodes that have a longitudinal direction parallel to the first direction and are arranged along a direction perpendicular to the first direction, the transfer board being disposed inside the casing so as to face the developer carrying surface in a second position upstream relative to the first position in the second direction, the transfer board being configured to transfer the development agent to the second position under a traveling-wave electric field generated when a multi-phase alternating-current voltage is applied to the transfer electrodes, such that the developer carrying member receives and carries the development agent on the developer carrying surface in the vicinity of the second position;

a board supporting member disposed inside the space surrounded by the casing main body and the side frames, the board supporting member being configured to support the transfer board on an outer surface thereof and extend from the developer storage section to the second position; and side seal members each of which is disposed to extend across a casing-side facing portion that is a portion of the casing and a supporting-member-side facing portion that is a portion of the board supporting member, the casing-side facing portion and the supporting-member-side facing portion facing one of both ends of the developer carrying surface in the first direction, each of the side seal member filling in a gap between the casing and one of both ends of the roller main body in the first direction so as to prevent the development agent from leaking to an outside of the casing via the gap, the side seal members being configured to contact both ends of the developer carrying surface as the roller main body slides relative to the side seal members.

2. The developer supply device according to claim 1, wherein, at a side corresponding to each end of the developer carrying surface in the first direction, the side seal supporting rib and the supporting-member-side facing portion are disposed adjacent to each other along the second direction in which the developer carrying surface moves.

3. The developer supply device according to claim 2, wherein the side seal supporting ribs and the board supporting member are disposed such that at the side corresponding to each end of the developer carrying surface in the first direction, the gap between the supporting-member-side facing portion and the developer carrying surface is as wide as the gap between the side seal supporting rib and the developer carrying surface.

4. The developer supply device according to claim 1, wherein the side seal members are disposed outside a predetermined area on the transfer board in the first direction, in which area the development agent is effectively transferred.

5. The developer supply device according to claim 1, wherein the transfer board is supported by the board supporting member with a tension provided between a first fixed portion fixed to the supporting-member-side facing portion and a second fixed portion that is an end of the transfer board in a predetermined direction along which the transfer electrodes are arranged.

6. The developer supply device according to claim 1, wherein the both ends of the developer carrying member in the first direction are attached to the side frames via substantially cylindrical bearings, respectively, wherein the board supporting member comprises projections that protrude in contact with the bearings, respectively, and wherein each of the side seal members comprises a notched portion formed such that one of the projections penetrates therethrough.

7. The developer supply device according to claim 1, wherein the developer carrying member is disposed in a position higher than the developer storage section, and wherein the transfer board is configured to transfer the development agent up toward the second position from the developer storage section.

8. The developer supply device according to claim 7, further comprising an auxiliary developer storage section disposed in a position adjacent to the developer storage section, wherein the auxiliary developer storage section is configured to store therein the development agent having passed through the second position, and wherein the transfer board is curved in an upside-down "U" shape when viewed in the first direction, so as to transfer the development agent, which has passed through the second position, toward the auxiliary developer storage section.

9. An image forming apparatus comprising:

a photoconductive body configured such that a development agent image is formed thereon; and a developer supply device configured to supply charged development agent to the photoconductive body, wherein the developer supply device comprises:

a roller-shaped developer carrying member comprising:

a cylindrical roller main body having a developer carrying surface that is formed as a cylindrical circumferential surface parallel to a first direction and configured to carry the development agent; and a shaft that protrudes outward from both ends of the roller main body in the first direction, the developer carrying member being configured to rotate around the shaft such that the developer carrying surface moves in a second direction perpendicular to the first direction to transfer the development agent carried thereon to a first position where the developer carrying surface faces the photoconductive body;

a casing comprising:

a casing main body formed as a U-shaped plate member having a substantially U-shaped cross-section along a plane perpendicular to the first direction;

side frames that are formed as flat plate members and disposed on both sides of the casing main body in the first direction, respectively, and side seal supporting ribs each of which is formed concentrically with the roller main body when viewed in the first direction and protrudes inward from an inner wall surface of one of the side frames, each of the side seal supporting ribs has a rib surface facing one of the both ends of the developer carrying surface in the first direction, wherein each of the side seal members is disposed to extend across the rib surface as the casing-side facing portion and the supporting-member-side facing portion, the casing main body and the side frames forming, inside a space surrounded thereby, a developer storage section configured to accommodate the development agent, the casing being configured to rotatably support the developer carrying member by the side frames at an opening of the U-shaped casing main body;

a transfer board comprising a plurality of transfer electrodes that have a longitudinal direction parallel to the first direction and are arranged along a direction perpendicular to the first direction, the transfer board being disposed inside the casing so as to face the developer carrying surface in a second position upstream relative to the first position in the second direction, the transfer board being configured to transfer the development agent to the second position under a traveling-wave electric field generated when a multi-phase alternating-current voltage is applied to the transfer electrodes, such that the developer carrying member receives and carries the development agent on the developer carrying surface in the vicinity of the second position;

a board supporting member disposed inside the space surrounded by the casing main body and the side frames, the board supporting member being configured to support the transfer board on an outer surface thereof and extend from the developer storage section to the second position; and side seal members each of which is disposed to extend across a casing-side facing portion that is a portion of the casing and a supporting-member-side facing portion that is a portion of the board supporting member, the casing-side facing portion and the supporting-member-side facing portion facing one of both ends of the developer carrying surface in the first direction, each of the side seal member filling in a gap between the casing and one of both ends of the roller main body in the first direction so as to prevent the development agent from leaking to an outside of the casing via the gap, the side seal members being configured to contact both ends of the developer carrying surface as the roller main body slides relative to the side seal members.

10. The image forming apparatus according to claim 9, wherein, at a side corresponding to each end of the developer carrying surface in the first direction, the side seal supporting rib and the supporting-member-side facing portion are disposed adjacent to each other along the second direction in which the developer carrying surface moves.

11. The image forming apparatus according to claim 10, wherein the side seal supporting ribs and the board supporting member are disposed such that at the side corresponding to each end of the developer carrying surface in the first direction, the gap between the supporting-member-side facing portion and the developer carrying surface is as wide as the gap between the side seal supporting rib and the developer carrying surface.

12. The image forming apparatus according to claim 9, wherein the side seal members are disposed outside a predetermined area on the transfer board in the first direction, in which area the development agent is effectively transferred.

13. The image forming apparatus according to claim 9, wherein the transfer board is supported by the board supporting member with a tension provided between a first fixed portion fixed to the supporting-member-side facing portion and a second fixed portion that is an end of the transfer board in a predetermined direction along which the transfer electrodes are arranged.

14. The image forming apparatus according to claim 9, wherein the both ends of the developer carrying member in the first direction are attached to the side frames via substantially cylindrical bearings, respectively, wherein the board supporting member comprises projections that protrude in contact with the bearings, respectively, and wherein each of the side seal members comprises a notched portion formed such that one of the projections penetrates therethrough.

15. The image forming apparatus according to claim 9, wherein the developer carrying member is disposed in a position higher than the developer storage section, and wherein the transfer board is configured to transfer the development agent up toward the second position from the developer storage section.

16. The image forming apparatus according to claim 15, wherein the developer supply device further comprises an auxiliary developer storage section disposed in a position adjacent to the developer storage section, wherein the auxiliary developer storage section is configured to store therein the development agent having passed through the second position, and wherein the transfer board is curved in an upside-down "U" shape when viewed in the first direction, so as to transfer the development agent, which has passed through the second position, toward the auxiliary developer storage section.

* * * * *